US006707386B1

(12) United States Patent
Pruisner

(10) Patent No.: US 6,707,386 B1
(45) Date of Patent: Mar. 16, 2004

(54) SECURITY MAT ALARM SYSTEM

(76) Inventor: Carla J. Pruisner, 16872 Hwy. 20, Aplington, IA (US) 50604

( * ) Notice: Subject to any disclaimer, the term of this patent is extended or adjusted under 35 U.S.C. 154(b) by 0 days.

(21) Appl. No.: 10/156,085

(22) Filed: May 28, 2002

(51) Int. Cl.[7] ..... G08B 21/00

(52) U.S. Cl. ..... 340/665; 340/541; 340/540; 340/568.1; 340/666; 307/116; 307/119; 702/41; 702/139

(58) Field of Search ..... 340/665, 541, 340/540, 568.1, 666; 307/116, 119; 702/41, 139

(56) References Cited

U.S. PATENT DOCUMENTS 3,894,437 A * 7/1975 Hagy et al. ..... 73/865.4
4,075,616 A * 2/1978 Rait ..... 340/666
4,888,581 A * 12/1989 Guscott ..... 340/666
5,134,386 A * 7/1992 Swanic ..... 340/541
5,148,002 A * 9/1992 Kuo et al. ..... 219/211
5,608,378 A * 3/1997 McLean et al. ..... 340/568.1
5,798,703 A * 8/1998 Sakai et al. ..... 340/666
5,832,296 A * 11/1998 Wang et al. ..... 710/3
6,515,586 B1 * 2/2003 Wymore ..... 340/541

FOREIGN PATENT DOCUMENTS

JP 59085190 A * 5/1984 ..... H04N/5/64
JP 10213499 A * 8/1998 ..... G01L/5/00

* cited by examiner

*Primary Examiner*—Daniel J. Wu
*Assistant Examiner*—Tai T. Nguyen

(57) ABSTRACT

A security mat alarm system having a pressure sensor sheet that is capable of detecting pressure and outputting a pressure sensed signal. A wireless transmitter is electrically connected to the pressure sensor sheet. The wireless transmitter is capable of transmitting an alarm signal upon detection of the pressure sensed signal. A wireless alarm receiver is capable of receiving the alarm signal and alarming.

7 Claims, 4 Drawing Sheets

SECURITY MAT ALARM SYSTEM

BACKGROUND OF THE INVENTION

1. Field of the Invention

The present invention relates to a security mat alarm system for use in connection with alarm systems. The security mat alarm system has particular utility in connection with alarm system for remotely detecting the movement of a person on a mat.

2. Description of the Prior Art

Security mat alarm systems are desirable for detecting the movement of a patient's body out of a bed or through a doorway alerting monitoring personnel, or an in-home care worker. Some patients are not fully lucid and movement to the out of doors could be dangerous, as in the case of an Alzheimer's patent. Also the security mat can be placed in front of a doorway to alert the user to an unauthorized access to a home or a particular room. The security mat may also be used to alert a user of the approach of a person stepping up to a doorway.

The use of alarm systems is known in the prior art. For example, U.S. Pat. No. 4,633,237 to Tucknott et al discloses a patient bed alarm system that includes a plurality of sensors defining interstices of a matrix of such sensors. The matrix is woven into a mat for placement on a bed in which a patent is confined. The presence of the patient's body upon the mat causes various combinations of sensors to perceive the presence of the patent's body thereon. The particular combinations of sensors sensing the presence of the body is inputted to a first computer which discriminates as to the exact location of the patent in view of the exact combination of sensors perceive in the presence of the patient's body. If the combination of the sensors actuated indicate an impending vacation of the bed by the patient an alarm can be actuated by a second computer to alert monitoring personnel of the situation. However, the Tucknott et al '237 patent does not include a wireless transmitter at the mat and a wireless receiver at the alarm for alarming when the mat senses an external weight upon it.

Similarly, U.S. Pat. No. 5,798,703 to Sakai et al discloses a mat sensor that has two sensor portions and an agreement or a disagreement of an on/off condition of the output from the two sensor portions. When the two sensor portions are in agreement then a normal judgment signal for both sensor portions is generated. When the normal judgment signal is generated and the two sensors are off, an operation permit signal for a moveable portion of the machine is generated. The presence or absence of a body is detected from a change in value of the electrostatic capacity of one sensor portion. In this way, a temporary poor contact attributable to deterioration of the sensor portion can also be detected, and the movable portion of the machine can be stopped. However, the Sakai et al '703 patent does not include a wireless transmitter at the mat and a wireless receiver at the alarm for alarming when the mat senses an external weight upon it.

Lastly, U.S. Pat. No. 4,175,263 to Triplett et al discloses a technique for monitoring whether an individual is moving from a particular area that has a first pressure sensor position to sense the weight of part of the patient's body in the normal position. The invention has a second pressure sensor is positioned for sensing the weight of part of a patient's body when a patient begins to leave the bed. The device includes an alarm and a pressure responsive switch connected to the first and second sensors to energize the alarm when the patient's weight is shifted from the first pressure sensor to the second pressure sensor. However, the Triplett et al '263 patent does not include a wireless transmitter at the mat and a wireless receiver at the alarm for alarming when the mat senses an external weight upon it.

While the above-described devices fulfill their respective, particular objectives and requirements, the aforementioned patents do not describe a security mat alarm system that allows alarm system for remotely detecting the movement of a person on a mat. The Tucknott et al '237, Sakai et al '703 and Triplett et al '263 patents make no provision for including a wireless transmitter at the mat and a wireless receiver at the alarm for alarming when the mat senses an external weight upon it.

Therefore, a need exists for a new and improved security mat alarm system that can be used for alarm system for remotely detecting the movement of a person on a mat. In this regard, the present invention substantially fulfills this need. In this respect, the security mat alarm system according to the present invention substantially departs from the conventional concepts and designs of the prior art, and in doing so provides an apparatus primarily developed for the purpose of alarm system for remotely detecting the movement of a person on a mat.

SUMMARY OF THE INVENTION

In view of the foregoing disadvantages inherent in the known types of alarm systems now present in the prior art, the present invention provides an improved security mat alarm system, and overcomes the above-mentioned disadvantages and drawbacks of the prior art. As such, the general purpose of the present invention, which will be described subsequently in greater detail, is to provide a new and improved security mat alarm system and method which has all the advantages of the prior art mentioned heretofore and many novel features that result in a security mat alarm system which is not anticipated, rendered obvious, suggested, or even implied by the prior art, either alone or in any combination thereof.

To attain this, the present invention essentially comprises a pressure sensor sheet that is capable of detecting pressure and outputting a pressure sensed signal. A wireless transmitter is electrically connected to the pressure sensor sheet. The wireless transmitter is capable of transmitting an alarm signal upon detection of the pressure sensed signal. A wireless alarm receiver is capable of receiving the alarm signal and alarming.

There has thus been outlined, rather broadly, the more important features of the invention in order that the detailed description thereof that follows may be better understood and in order that the present contribution to the art may be better appreciated.

The invention may also include an audible alarm element, a beacon element, a power switch, an incoming alternating current electrical cord, a battery connection and a battery cover. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved security mat alarm system that has all of the advantages of the prior art alarm systems and none of the disadvantages.

It is another object of the present invention to provide a new and improved security mat alarm system that may be easily and efficiently manufactured and marketed.

An even further object of the present invention is to provide a new and improved security mat alarm system that has a low cost of manufacture with regard to both materials and labor, and which accordingly is then susceptible of low prices of sale to the consuming public, thereby making such security mat alarm system economically available to the buying public.

Still another object of the present invention is to provide a new security mat alarm system that provides in the apparatuses and methods of the prior art some of the advantages thereof, while simultaneously overcoming some of the disadvantages normally associated therewith.

Even still another object of the present invention is to provide a security mat alarm system for alarm system for remotely detecting the movement of a person on a mat.

Lastly, it is an object of the present invention is to provide a security mat alarm system that has a touch sensitive detection mat and a wireless relay featuring visual and audible notification options.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
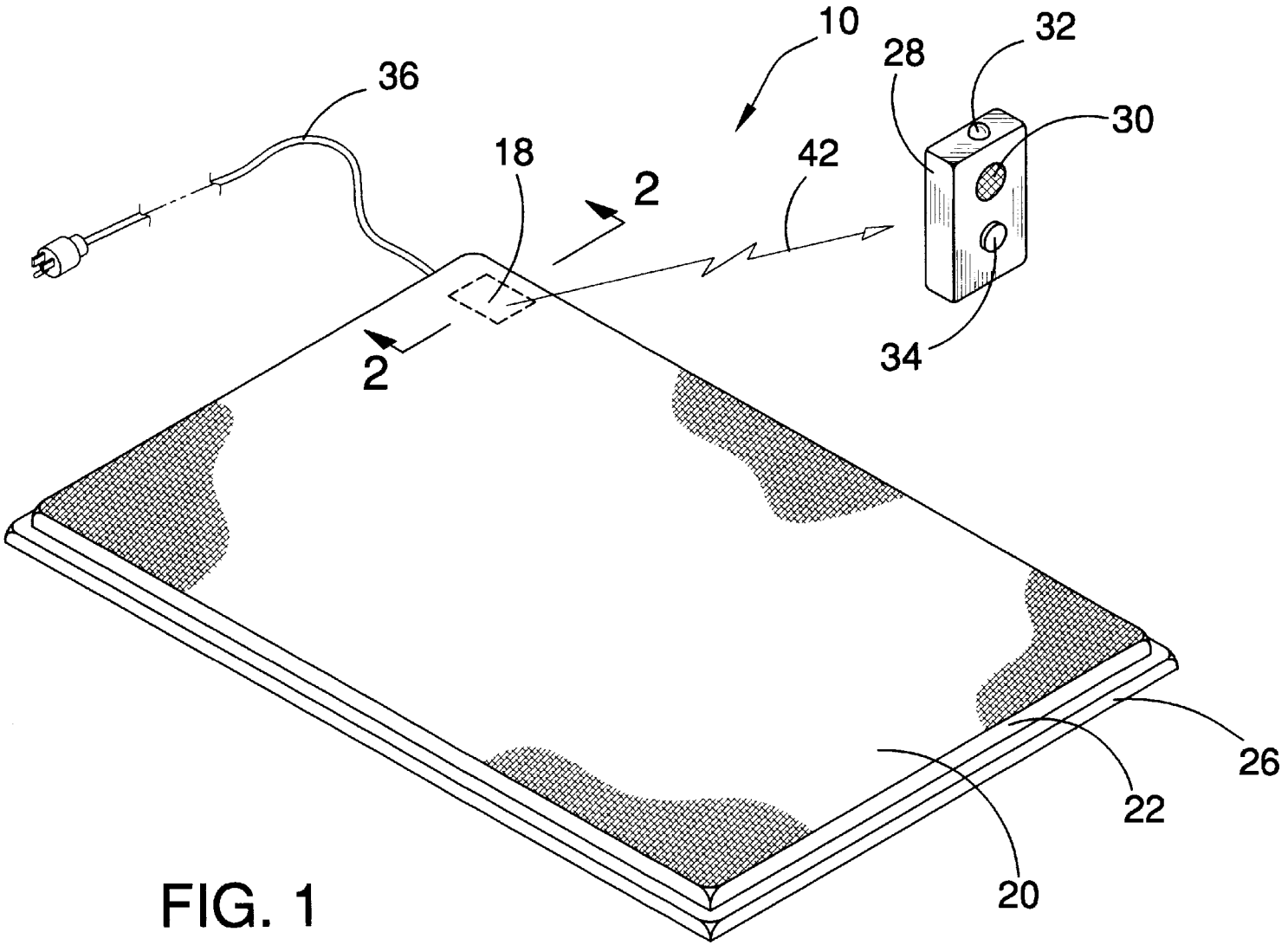
FIG. 1 is a top perspective view of the preferred embodiment of the security mat alarm system constructed in accordance with the principles of the present invention.

Referring now to the drawings, and particularly to FIGS. 1–4, a preferred embodiment of the security mat alarm system of the present invention is shown and generally designated by the reference numeral 10.

In FIG. 1, a new and improved security mat alarm system 10 of the present invention for alarm system for remotely detecting the movement of a person on a mat is illustrated and will be described. A waterproof top cover 20 has a peripheral edge 22. A waterproof bottom cover 24 has a peripheral edge 26. The bottom cover peripheral edge 26 is connected to the top cover peripheral edge 22. A wireless alarm receiver 28 is capable of receiving an alarm signal 42. An audible alarm element 30 is connected to the alarm receiver 28. A beacon element 32 is connected to the alarm receiver 28. A power switch 34 is connected to the alarm receiver 28. An incoming alternating current electrical cord 36 is connected to the bottom cover 24. The alarm receiver 28 is portable in the present example.

Figure 2:
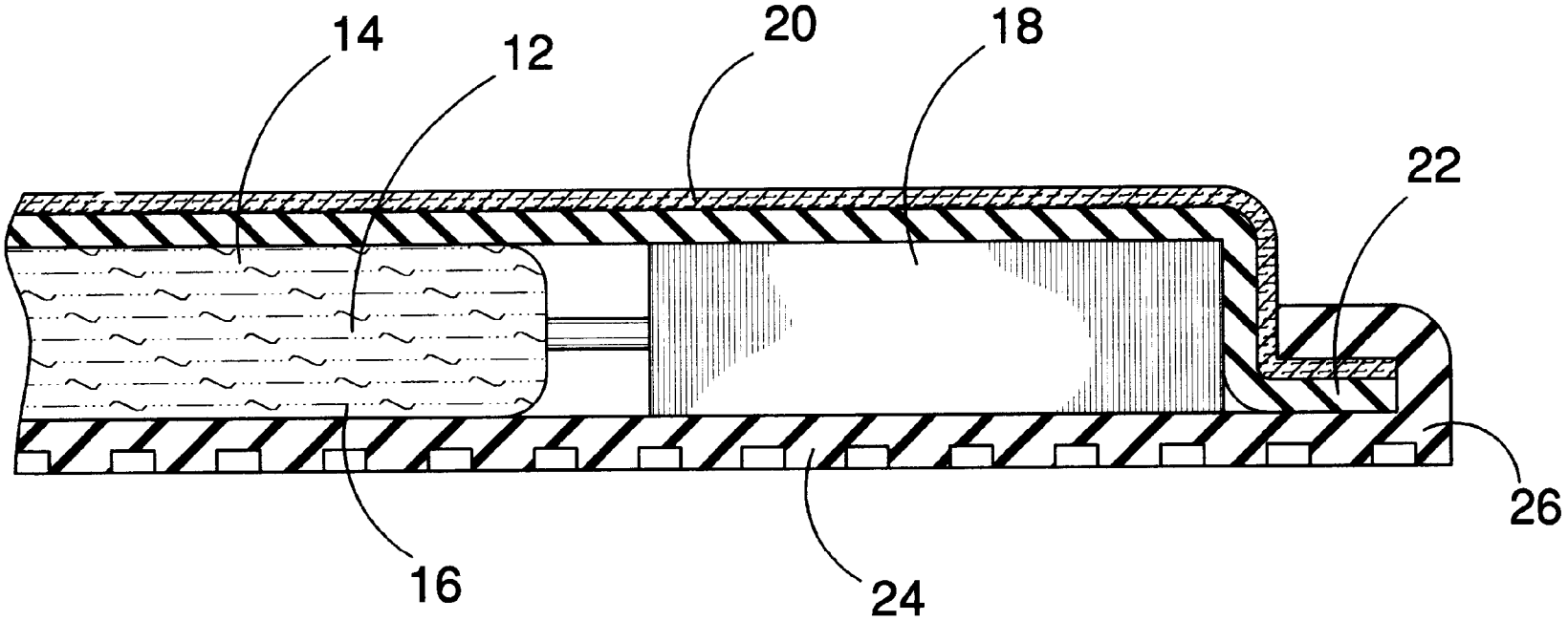
FIG. 2 is a section 2—2 view of FIG. 1 of the security mat alarm system of the present invention.

In FIG. 2, the security mat alarm system 10 is illustrated and will be described. The security mat alarm system 10 has a pressure sensor sheet 12 that is capable of detecting pressure and outputting the pressure sensed signal. The pressure sensor sheet 12 has a top portion 14 and a bottom portion 16. A wireless transmitter 18 is electrically connected to the pressure sensor sheet 12. The wireless transmitter 18 is capable of transmitting the alarm signal upon detection of the pressure sensed signal. The top cover 20 is connected to the pressure sensor sheet top portion 14. The top cover 20 has the peripheral edge 22. The bottom cover 24 is connected to the pressure sensor sheet bottom portion 16. The bottom cover 24 has the peripheral edge 26. The bottom cover peripheral edge 26 is connected to the top cover peripheral edge 22. The alarm receiver 28 is capable of receiving the alarm signal. The incoming alternating current electrical cord 36 is electrically connected to the wireless transmitter 18.

Figure 3:
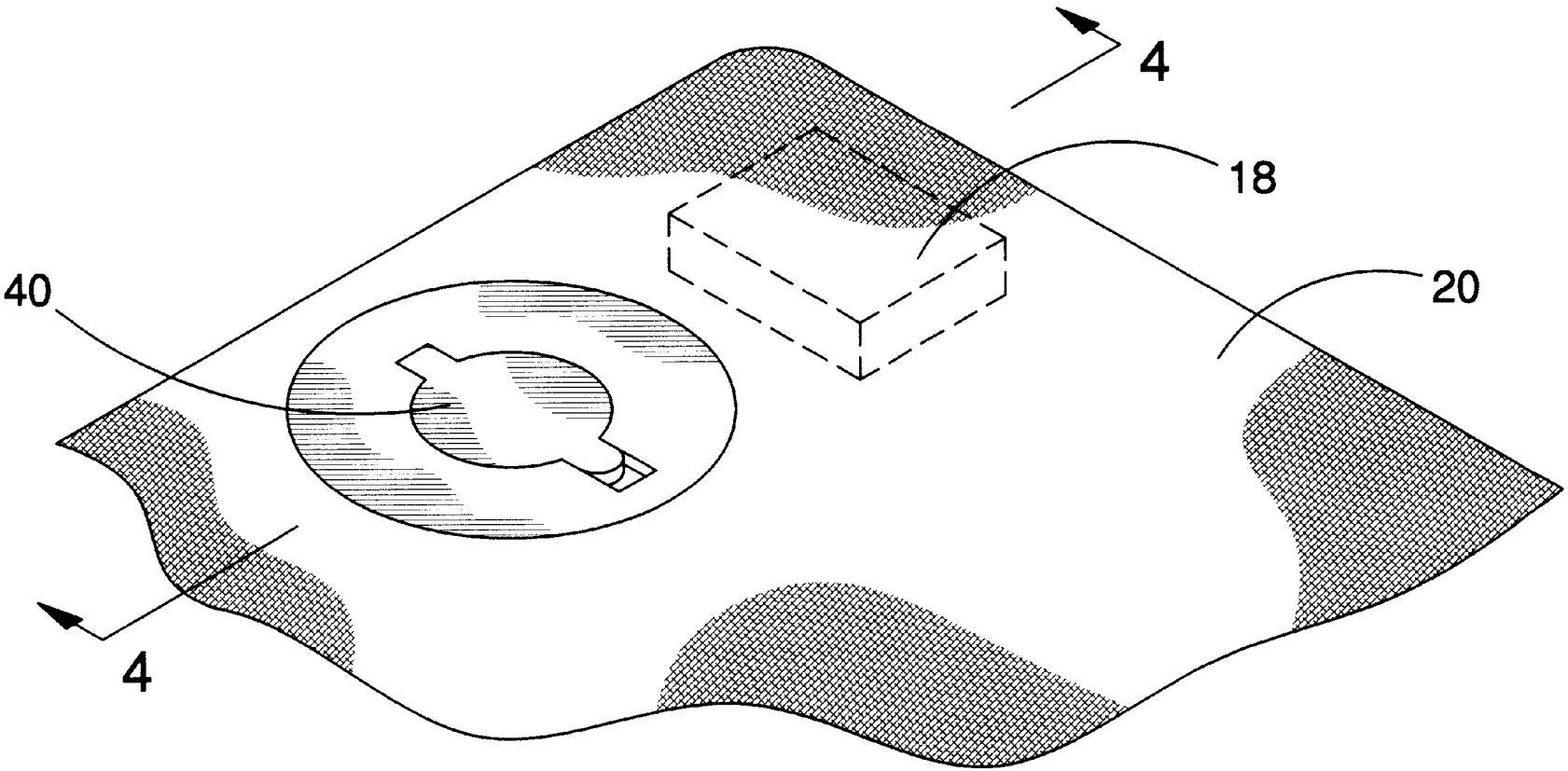
FIG. 3 is a top perspective view of a second embodiment of the security mat alarm system of the present invention.

In FIG. 3, the security mat alarm system 10 is illustrated and will be described. A battery cover 40 is flexibly connected to the top cover 20.

Figure 4:
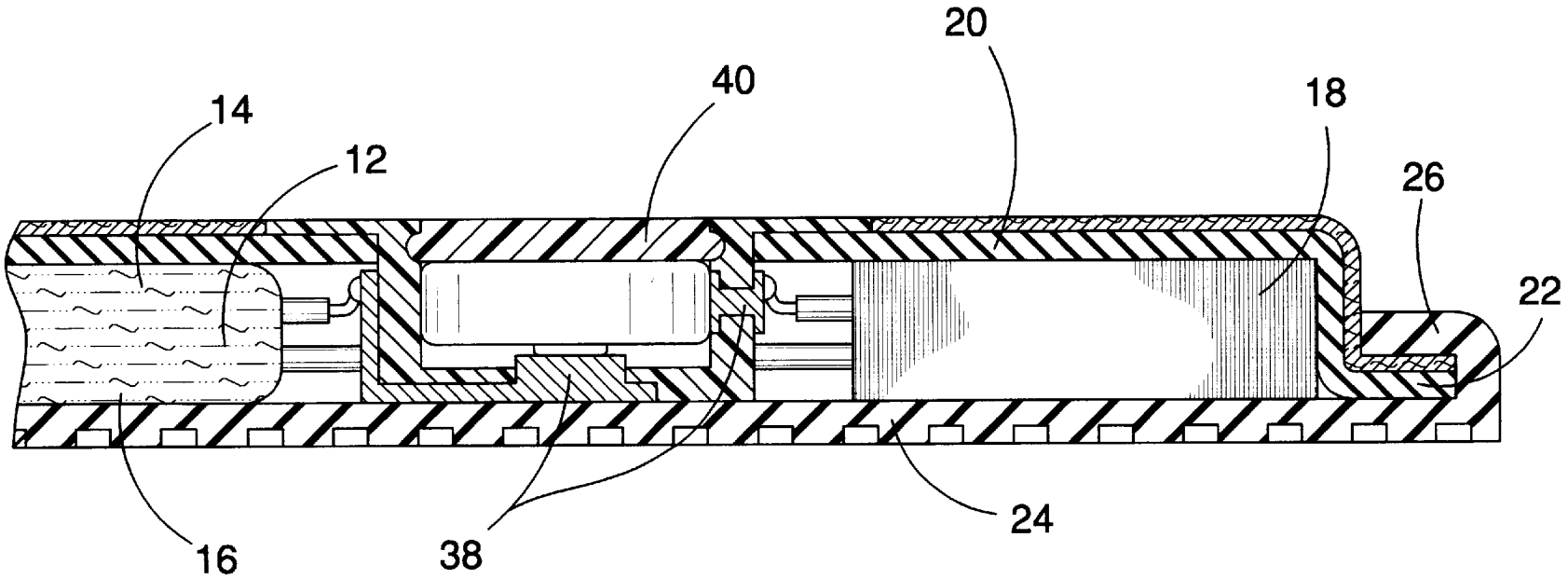
FIG. 4 is a section 4—4 view of FIG. 3 of the security mat alarm system of the present invention.

In FIG. 4, the security mat alarm system 10 is illustrated and will be described. The security mat alarm system 10 has the pressure sensor sheet 12 that is capable of detecting pressure and outputting the pressure sensed signal. The pressure sensor sheet 12 has the top portion 14 and the bottom portion 16. The wireless transmitter 18 is electrically connected to the pressure sensor sheet 12. The wireless transmitter 18 is capable of transmitting the alarm signal upon detection of the pressure sensed signal. The top cover 20 is connected to the pressure sensor sheet top portion 14. The top cover 20 has the peripheral edge 22. The bottom cover 24 is connected to the pressure sensor sheet bottom portion 16. The bottom cover 24 has the peripheral edge 26. The bottom cover peripheral edge 26 is connected to the top cover peripheral edge 22. A battery connection 38 is electrically connected to the wireless transmitter 18. The battery cover 40 is flexibly connected to the top cover 20.

In use, it can now be understood that when someone steps upon the top cover 20 and depresses the pressure sensor sheet 12 the alarm signal is sent from the wireless transmitter 18 to the alarm receiver 28. The alarm receiver 28 has the power switch 34 that if it is in the on position will energize the audible alarm element 30 and the beacon element 32.

While a preferred embodiment of the security mat alarm system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable pressure sensor may be used instead of the piezoelectric film described. Also, the lower and upper layers may be made of any suitable waterproof material. And although alarm system for remotely detecting the movement of a person on a mat have been described, it should be appreciated that the security mat alarm system herein described is also suitable for detecting the presence of a person at an operational tool. Furthermore, a wide variety of sizes and colors may be used instead of the black rubber outer layers described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A security mat alarm system comprising:

a pressure sensor sheet capable of detecting pressure and outputting a pressure sensed signal, said pressure sensor sheet having a top portion and a bottom portion;

a wireless transmitter electrically connected to said pressure sensor sheet, said wireless transmitter capable of transmitting an alarm signal upon detection of said pressure sensed signal;

a water proof top cover connected to said pressure sensor sheet top portion, said top cover having a peripheral edge;

a bottom cover connected to said pressure sensor sheet bottom portion, said bottom cover having a peripheral edge, said bottom cover peripheral edge is locked into said top cover peripheral edge; and a wireless alarm receiver capable of receiving said alarm signal.

2. The security mat alarm system of claim 1 further comprising:

an incoming alternating current electrical cord electrically connected to said wireless transmitter.

3. The security mat alarm system of claim 1 further comprising:

a battery connection electrically connected to said wireless transmitter.

4. The security mat alarm system of claim 1 further comprising:

a battery cover flexibly connected to said top cover.

5. The security mat alarm system of claim 1 further comprising:

a beacon element connected to said alarm receiver.

6. The security mat alarm system of claim 1 further comprising:

a power switch connected to said alarm receiver.

7. A security mat alarm system comprising:

a pressure sensor sheet capable of detecting pressure and outputting a pressure sensed signal, said pressure sensor sheet having a top portion and a bottom portion;

a wireless transmitter electrically connected to said pressure sensor sheet, said wireless transmitter capable of transmitting an alarm signal upon detection of said pressure sensed signal;

a water proof top cover connected to said pressure sensor sheet top portion, said top cover having a peripheral edge;

a bottom cover connected to said pressure sensor sheet bottom portion, said bottom cover having a peripheral edge, said bottom cover peripheral edge is locked into said top cover peripheral edge;

a portable wireless alarm receiver capable of receiving said alarm signal;

an audible alarm element connected to said alarm receiver;

a beacon element connected to said alarm receiver; and a power switch connected to said alarm receiver.

* * * * *